United States Patent [19]

Jennings et al.

[11] Patent Number: 4,887,738

[45] Date of Patent: Dec. 19, 1989

[54] ARTICLE DISPENSER

[76] Inventors: Paul D. Jennings, 1039 E. Almond Ave., Orange, Calif. 92666; Kenneth L. Jennings, P.O. Box 83-4, Rte. 2, Strafford, Mo. 65757

[21] Appl. No.: 218,469

[22] Filed: Jul. 14, 1988

Related U.S. Application Data

[63] Continuation of Ser. No. 24,849, Mar. 17, 1987, abandoned, which is a continuation-in-part of Ser. No. 777,969, Sep. 20, 1985, abandoned.

[51] Int. Cl.[4] ..... B65G 59/00

[52] U.S. Cl. ..... 221/264; 221/289; 221/221; 221/306

[58] Field of Search ..... 221/186, 190, 263, 289, 221/296, 65, 264, 297, 221, 223, 306; 453/50

[56] References Cited

U.S. PATENT DOCUMENTS

| | | | |
|---|---|---|---|
| 2,901,146 | 8/1959 | Powell, Jr. et al. | 221/190 |
| 3,166,216 | 1/1965 | Guarr | 221/289 |
| 3,243,081 | 3/1966 | Schmank | 221/186 |
| 3,998,238 | 12/1976 | Nigro | 221/297 X |
| 4,653,668 | 3/1987 | Gibilisco et al. | 221/298 |

FOREIGN PATENT DOCUMENTS

| | | | |
|---|---|---|---|
| 863472 | 9/1981 | U.S.S.R. | 221/288 |

*Primary Examiner*—Joseph J. Rolla
*Assistant Examiner*—Mona C. Beegle
*Attorney, Agent, or Firm*—Leonard Tachner

[57] ABSTRACT

An article dispenser especially advantageous for dispensing pills of the prescription drug or over-the-counter type, comprises three components including a container member, a dispenser control member and a flexible member. The container member provides a dispenser portion through which the articles are passed in a serial array whereby one article reaches an exit aperture while the remaining articles are restrained at gate apertures within the dispenser portion by the flexible member and the control member. The dispenser components are preferably made of low-cost molded plastic and when assembled provide an easy access dispenser not requiring two hands for activation.

9 Claims, 3 Drawing Sheets

ARTICLE DISPENSER

This is a continuation of parent application Ser. No. 024,849, filed Mar. 17, 1987, now abandoned, which was a continuation of Ser. No. 777,969 filed Sept. 20, 1985 and is now abandoned.

BACKGROUND OF THE INVENTION

1. Field of the Invention

This invention relates to the art of containers and particularly, to the art of capless containers for use in dispensing medicine.

2. Prior Art

Containers which have caps for allowing an opening to be covered or uncovered are known in the art. These containers come in a variety of shapes and sizes and are used for a variety of materials. A body portion typically serves to contain the material being stored and also provides an opening such as a threaded neck for attaching a cap. Many of these containers are designed to be child-proof by providing caps which must be manipulated in a particular fashion in order to be removed. While many of these containers may be successful in preventing children from gaining access to the contents, they also prevent adults who may be arthritic or paralyzed or who, for some other reason have the use of only one hand, from opening the containers. Thus, these types of containers have limited usefulness since they cannot be used by adults unable to open them. One solution to this problem is disclosed in U.S. Pat. No. 4,522,313 issued on June 11, 1985 to the coinventors of the present invention. This patent discloses an article dispenser in which the articles are stored in a vessel having a sphere pivotally suspended from the vessel for rotation in only one direction about a singular axis that is offset from a second axis. The article within the container is conveyed from its stored location within the vessel into a cavity in the sphere and from the cavity to a location external to the vessel when the sphere is located. While the above-noted invention of Pat. No. 4,522,313 provides an elegant solution to the aforementioned problem, alternative solutions which may be less expensive to manufacture or assemble or which involve a different type of motion by the user to gain access to the articles contained therein would be highly desirable to achieve.

SUMMARY OF THE INVENTION

The present invention comprises an article dispenser having a container portion and a dispenser control member, the former being in coaxial contiguous engagement with the latter for selective relative slideable motion therebetween. A flexible member is mounted to a dispenser portion of the container member for engagement with the interior surface of the dispenser control member to automatically regulate the release of articles from the article dispenser so that a selected quantity of such articles, such as one such article, are released upon each selective activation of the article dispenser.

The present invention has particularly advantageous application in the pharmaceutical industry for containing and dispensing pills such as vitamin pills, prescription drug pills or other products which can be conveniently packaged in pill form. It will be seen hereinafter that one of the principal advantages of the present invention resides in its convenience of use for the purpose of dispensing such pills, one at a time, while requiring little or no grasping and the application of a nominal pressure for activation by the user's palm or other body surface to release a single pill. Other advantages of the present invention relate to its simplicity and economy of structure. More specifically, the invention comprises only three separate units which are readily and easily integrated in an assembly process. Furthermore, each of these units is preferably made of a readily moldable plastic thereby enabling high volume and low-cost production minimizing the retail costs of the invention and rendering it readily available to the general public. Such a dispenser is particularly important to those who, for reasons of handicap or other reasons, would find it especially useful to be able to dispense a pill in such a simple and convenient manner without requiring the use of two hands. Of course, the latter advantage is not necessarily limited to handicapped individuals such as arthritic patients and the like who would find the dispenser of the present invention particularly advantageous for their particular limitations. The ease of dispensing articles by means of the present invention, which may be readily accomplished by the use of one hand or other body surface, is also particularly beneficial to individuals who would otherwise ordinarily have the use of both hands but are in situations where it is not convenient to employ both hands. By way of example, an individual driving a vehicle who wishes to dispense a pill by means of the present invention, a pill which he or she must take at a particular time during driving, would find it particularly advantageous to use the present invention whereby it is not necessary to remove both hands from the steering wheel of the vehicle.

OBJECTS OF THE INVENTION

It is therefore a principal object of the present invention to provide an article dispenser of the type which may be advantageously used for dispensing pills such as vitamins and pharmaceuticals and which dispenser is readily activated by simply compressing the dispenser against a stationary surface.

It is an additional of the present invention to provide an article dispenser of the type particularly adapted for dispensing pill-shaped articles such as vitamins and pharmaceuticals and the like and which is designed to be manufactured at low-cost using plastic molding processes and which is especially simple and easy to operate to dispense a pill or other solid article.

It is still an additional object of the present invention to provide a three-piece article dispenser having a container for housing a plurality of solid articles to be dispensed, a dispenser control member which may be made to move in slideable engagement with the container for selectively releasing one article at a time and a flexible member which serves the dual purpose of providing spring action between the movement of the container and the dispenser control member and also provides means for preventing the dispensing of more than one article at a time.

BRIEF DESCRIPTION OF THE DRAWINGS

The aforementioned objects and advantages of the present invention as well as additional objects and advantages thereof will be more fully understood hereinafter as a result of a detailed description of a preferred embodiment of the invention when taken in conjunction with the following drawings.

DETAILED DESCRIPTION OF A PREFERRED EMBODIMENT

Figure 1:
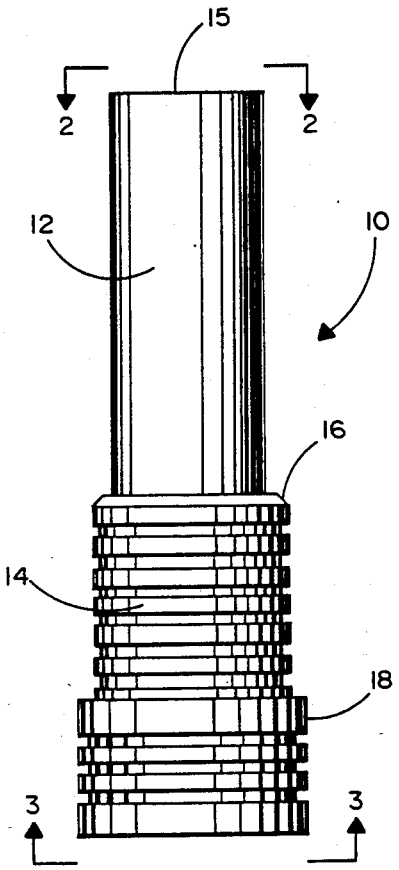
FIG. 1 is an elevation view of the invention.
Figure 1A:
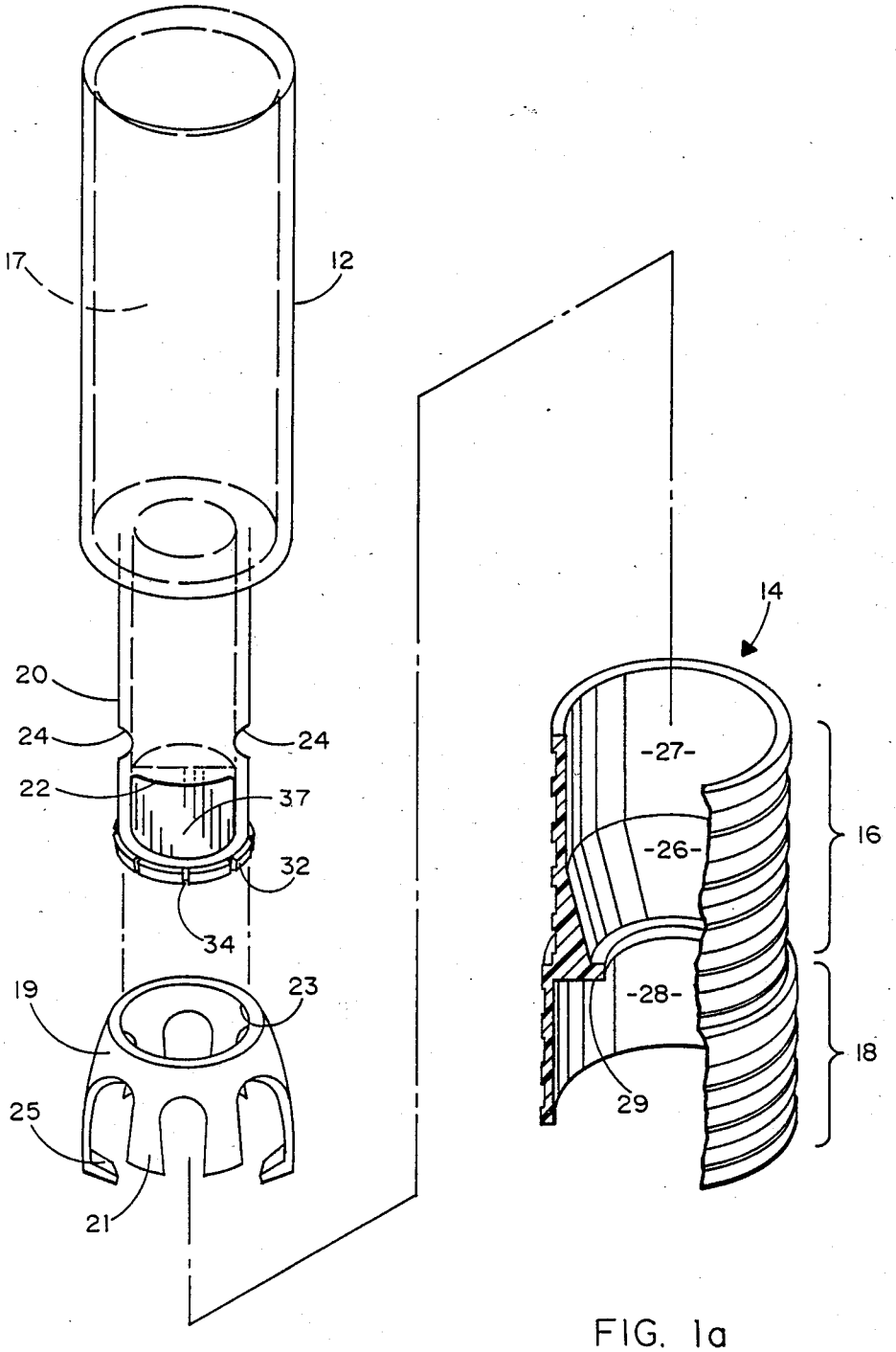
FIG. 1*a* is a three-dimensional exploded view of the invention.

Referring first to FIGS. 1 and 1*a*, it will be seen that the article dispenser 10 of the present invention comprises three principal components, namely, a container member 12, a flexible member 19 and a dispenser control member 14. In the particular embodiment disclosed herein container member 12 comprises a substantially cylindrical housing or upper portion forming an interior chamber or compartment 17 adapted to contain a selected plurality of articles to be dispensed. The lower portion of container member 12 is integral with a dispenser portion 20 which provides a narrow channel formed by the conical surface 13 within the container member 12 and which is adapted to pass the articles therethrough in a serial fashion so that two articles cannot pass simultaneously through the interior of dispenser portion 20. Obviously the dimensions of the interior compartment 17 and of the dispenser portion 20 can be varied depending upon the size of the articles to be dispensed.

Figure 3:
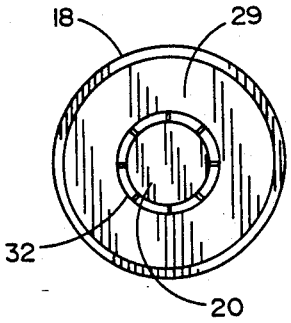
FIG. 3 is a bottom view of the invention.
Figure 4:
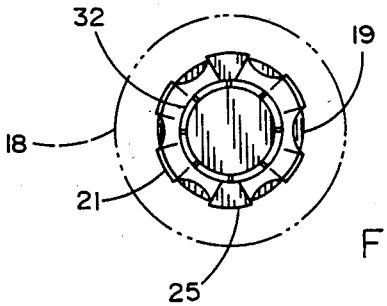
FIG. 4 is a bottom view of the invention with a portion shown in phantom to illustrate the manner in which the invention operates.

As seen further in FIG. 1*a*, dispenser portion 20 is provided with three apertures, namely, an article exit aperture 22 through which the articles pass for dispensing to the exterior of the invention and a pair of gate apertures 24 the purpose and function of which will be described hereinafter in more detail. The lower-most surface of dispenser portion 20 is solid as seen in FIGS. 3 and 4 and is surrounded by an annular flange 32 which is periodically broken by a plurality of equally spaced gaps or spaces 34 as seen in FIG. 1*a*. An inclined smooth surface 37 adjacent aperture 22 assures that each article will be dispensed upon activation of the invention.

Flexible member 19 is shaped in the form of a truncated paraboloid having a frusto-conical contour having an upper portion opening 23 which is of appropriate dimensions to slip onto the dispenser portion 20 of container member 12 so that the top surface of flexible member 19 engages the bottom surface of the compartment 17 adjacent the transition to the smaller diameter dispenser portion 20. Flexible member 19 is provided with a plurality of flexible fingers 21 spaced substantially equidistant around the perimeter of the flexible member. Two of the flexible fingers 21 are extended and provided with respective gating protrusions 25. When flexible member 19 is in its proper position on dispenser portion 20, the gating protrusions 25 are situated in juxtaposition to gate apertures 24 so that when gating protrusions 25 are compressed toward the axis of dispenser portion 20, they project into and through the gate apertures 24 which as will be seen hereinafter is the method by which the article dispenser 10 of the present invention may be used to dispense only one article at a time. Furthermore, the function of flexible fingers 21 including those which are elongated and provide the gating protrusions 25 is to form a spring-type resistance to the activation of the dispenser and to automatically reset the dispenser in its inactive mode subsequent to activation and dispensing of one article.

The actual dispensing operation of the invention is made possible by the relative movement between the container 12 and the dispenser control member 14. As seen best in FIG. 1*a*, dispenser control member 14 comprises two integral sections, namely, an upper section 16 and a lower section 18.

As seen in the right-most portion of FIG. 1*a*, dispenser control member 14 is of generally cylindrical shape, the interior surface of which is non-uniform. More specifically, it is seen that the upper section 16 of dispenser control member 14 has two distinct surface geometries. Interior surface 27 at the upper-most portion of activating portion 16 is of uniform diameter. However, the interior surface 26 at the lower-most portion of upper section 16 is of a conical shape with a diameter which is linearly reduced toward the lower section 18 and is smallest immediately adjacent an annular ridge 29 which defines the upper-most interior of the lower section 18. The remainder of the interior of the base portion 18 is a constant diameter surface of the base interior 28.

As seen best in FIG. 1*a* both the exterior and interior surfaces of lower section 18 are larger in diameter than the corresponding surfaces of upper section 16. The interior surface 27 has a diameter which is only slightly larger than the diameter of the container portion 17 of container member 12 and is in fact adapted to overlie the exterior surface of container member 12 in slideable engagement therewith when the three components shown in FIG. 1 are fully assembled. In this assembled configuration, the conical interior surface 26 is in slideable engagement with the flexible fingers 21 of flexible member 19 and the annular ridge 29 is of appropriate dimension to slideably engage the exterior surface of dispenser portion 20 while the outer diameter of flange 32 is sufficiently large to provide resistance of the passage of annular ridge 29 thereover. In fact, it may be preferable in certain embodiments of the invention to make flange 32 of the type which permits passage of ridge 29 only in one direction for assembly of the invention but stops passage of ridge 29 in the opposite direction so that the article dispenser 10 cannot be disassembled by the user without actually breaking the annular flange 32.

Figure 2:
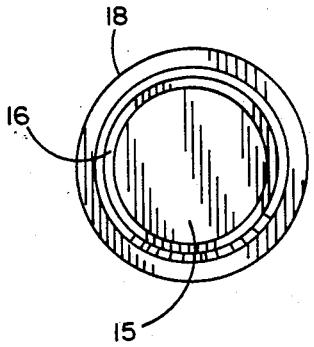
FIG. 2 is a top view of the invention.

When the article dispenser 10 of the invention is fully assembled as shown in FIG. 1, the top and bottom views of the invention are as shown in FIGS. 2 and 3, respectively. More specifically, as seen in FIG. 2, at the top view one may see the outer edge of the base portion 18 of dispenser control member 14, the beveled edge of upper section 16 and a sealable cap 15 which may be used to enable easy filling of the compartment 17 with articles to be dispensed and sealing of the compartment 17 in a substantially permanent fashion if it is desired to prevent reuse of the dispenser or cap 15 may be made relatively easy to remove if one wishes to allow the user to refill the compartment 17 after all articles have been dispensed.

The bottom view provided in FIG. 3 illustrates the relationship between the outer surface of lower section 18 from which the annular ridge 29 extends radially towards the center or axis of the dispenser where it engages the annular flange 32 which, in turn, surrounds the lower terminal surface of dispenser portion 20.

Figure 7:
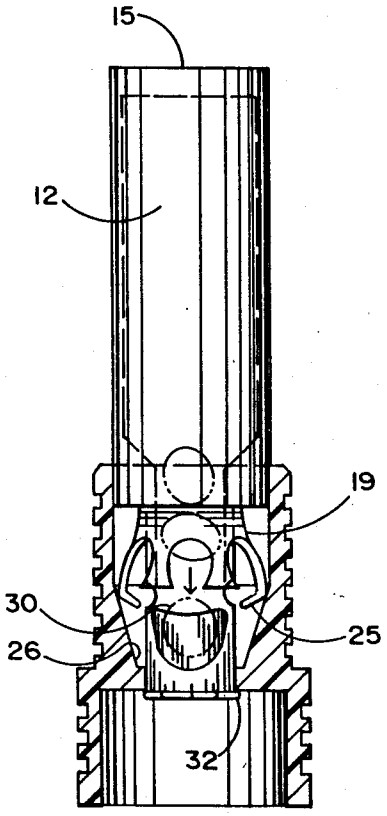
FIGS. 5–7 are sequential, partially cross-sectioned views of the invention showing the manner in which the various components thereof interact prior to, during and subsequent to selective dispensing of an article.
Figure 6:
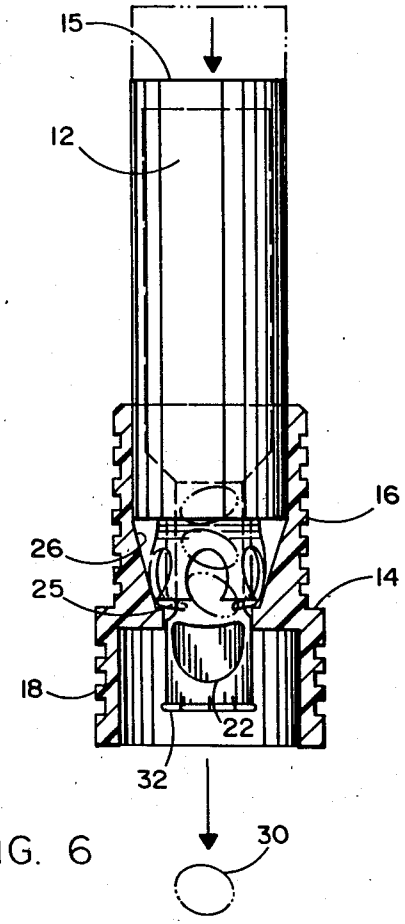
Figure 5:
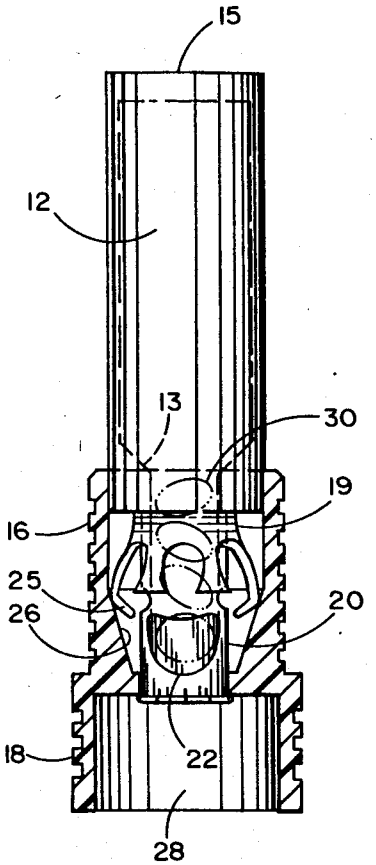

The operation of the article dispenser 10 of the present invention when fully assembled may be best understood by reference to FIGS. 5, 6 and 7 in which it will be seen that the compartment 17 of the container member 12 is provided with a plurality of pill-shaped articles 30. Initially, prior to activation of the dispenser for releasing an article 30 therefrom, the dispenser is in the configuration illustrated in FIG. 5 wherein dispenser control member 14 is shown in a cross-sectional view to enable observation of the operation of the dispenser. In referring to FIG. 5 it will be seen that the articles 30 are serially arranged within the dispenser portion 20 of the container member 12 with one such article being positioned within the dispenser portion 20 immediately adjacent the article exit aperture 22 near the bottom of the dispenser portion 20. In this inactivated configuration, that lower-most article 30 is prevented from leaving the article exit aperture 22 because of the adjacent and surrounding conical surface 26. Furthermore, it will be seen in the inactivated configuration of FIG. 5, that the article dispenser 10 is in a condition whereby the flexible fingers 21, including the two fingers which include the gating protrusions 25, are in their relaxed position whereby they are allowed to extend radially outward as far as they can against the largest diameter position of the conical surface 26.

The activated configuration of the article dispenser 10 is illustrated in FIG. 6. In this configuration it is seen that the container member 12 is forced downwardly relative to dispenser control member 14 which is positioned in a fixed or stable configuration relative to an underlying surface such as a table top. Furthermore, it will be seen that the lower-most part of the dispenser portion 20 has been extended into the base interior of lower section 18 of the dispenser control member 14. Consequently, the article 30 positioned in FIG. 5 immediately adjacent the article exit aperture 22 is no longer contained to remain within the dispenser portion 20 and is in fact free to fall from the exit aperture, the base 37 of which as previously indicated, is inclined and smooth to facilitate the dropping of the article 30. Furthermore, it will be seen in FIG. 6 that when the article dispenser is in its activated configuration, flexible member 19 also travels downwardly relative to dispenser control member 14 thereby causing the flexible fingers 21 to come into compressive engagement with the reduced diameter portion of conical control surface 26 within the lower interior of upper section 16 of the dispenser control member. As a result of this compressive engagement between flexible member 19 and control surface 26, the gating protrusions 25 are forced into the gate apertures 24 where they engage the next article above the article 30 which has just been released or dispensed through the article exit aperture 22 as also shown in FIG. 6. As a result, this next article, as well as all articles aligned above it within dispenser portion 20 and compartment 17, are prevented by gating protrusions 25 from also exiting at the same time.

When the force applied to the top surface of container member 12 to activate the article dispenser is removed, the dispenser reassumes its inactive configuration here shown in FIG. 7. The configuration of FIG. 7 is identical to that of FIG. 5 except that in the configuration of FIG. 7, the next article 30 is now permitted to drop within the dispenser portion 20 of the dispenser control member 14 until it is positioned adjacent the article exit aperture 22 whereby it will be dispensed upon the subsequent activation of the article dispenser 10. It will be understood therefore that each individual activation of article dispenser 10 which in effect includes the three configurations of FIGS. 5, 6 and 7, respectively in that sequence, results in the dispensing of one article contained within the dispenser until the compartment 17 has been emptied.

It will now be understood that what has been disclosed herein comprises a novel, unique and highly advantageous article dispenser which comprises three relatively simple and therefore low-cost components, each of which may be manufactured using low-cost plastic molding techniques. Because of the innovative construction of the article dispenser of the invention, one article at a time may be dispensed with a minimum of activating control imparted by the user. More specifically, the user may merely press down on the top of the compartment portion thereof to release one article onto an underlying surface. Such simple activation is highly advantageous in particular where the article dispenser of the present invention is for example, used to contain prescription drugs in pill form or vitamins which may be readily released or dispensed from the compartment thereof by using only one hand or by using any body surface for applying a unidirectional force against the top of the container member. Such article dispensers would of course be highly advantageous to those who are in some way handicapped or are otherwise unable to open a container in a conventional manner by using two hands.

Those having skill in the art to which the present invention pertains will now as a result of the teaching herein disclosed contemplate various modifications and additions to the invention. By way of example, alternative configurations and dimensions suitable for dispensing articles of different shapes and sizes and in different quantities will now occur to those having the benefit of the applicants' teaching herein. However, it is to be understood that all such modifications and additions are deemed to be within the scope of the present invention which is to be limited only by the claims appended hereto.

We claim:

1. An article dispenser for containing and selectively singularly dispensing articles comprising:

a container member having an upper portion and a dispensing portion forming an interior compartment for storing said articles, said upper portion having a greater external diameter than an external diameter of said dispenser portion defining a shoulder at an interface therebetween, said dispensing portion having an article dispenser aperture formed therethrough and at least one gate aperture;

a substantially frusto-conically contoured flexible member having an upper portion opening a diameter substantially equal to said external diameter of said dispensing portion and less than said diameter of said upper portion, said frusto-conical flexible member having a lower portion defining a plurality of flexible finger members having at least one gating protrusion extending from at least one of said flexible finger members for insert into said gate aperture;

a dispenser control member defining a through passage having an upper section of first substantially uniform internal diameter for slideable interface with said container member upper portion, a central section defining an internal frusto-conical surface which is inverted with respect to said frusto-conically contoured flexible member, and a lower section having a second substantially uniform internal diameter, whereby contact between said flexible member and said lower section of said control member provides (1) a biasing displacement for maintaining said exit aperture adjacent said central section of said dispenser control member, and (2) displacement of said gating protrusions into said gate aperture responsive to a displacement of said upper section of said dispenser control member with respect to said container member.

2. The article dispenser as recited in claim 1 where said external diameter of said dispenser portion is sufficiently less than said internal diameter of said dispenser control member lower section to permit release of one of said articles through said article dispenser aperture from said interior compartment.

3. The article dispenser as recited in claim 2 where said gating protrusion of said flexible finger member is radially displaced into said gate aperture of said dispensing portion of said container member as one of said articles is released through said article dispenser aperture for blocking exit of other article stored in said interior compartment.

4. The article dispenser as recited in claim 1 where said frusto-conically contoured flexible member returns said container member to its initial position relative to said control member subsequent to an initial displacement of said dispenser control member with respect to said container member.

5. The article dispenser as recited in claim 1 where said dispenser control member lower section in combination with an external surface on which said article dispenser rests forms an external chamber for capturing said exited article.

6. The article dispenser as recited in claim 1 where said container member is formed in one-piece molded formation.

7. The article dispenser as recited in claim 6 where said flexible member is formed in one-piece molded configuration being composed of a resilient plastic composition.

8. The article dispenser as recited in claim 1 including access means formed on one end of said container member opposing said article dispensing aperture for insertion and removal of articles from said interior compartment without removal of said flexible member and said dispenser control member therefrom.

9. The article dispenser as recited in claim 8 where said access means includes a releasable cap member coupled to said one end of said container member opposing said article dispensing aperture.

* * * * *